US006361153B1

(12) United States Patent
Wafler

(10) Patent No.: US 6,361,153 B1
(45) Date of Patent: Mar. 26, 2002

(54) PRELOAD OF DATA PRIOR TO FIRE PULSE BY USING A DUAL BUFFER SYSTEM IN INK JET PRINTING

(75) Inventor: Walter F. Wafler, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/505,873

(22) Filed: Feb. 17, 2000

(51) Int. Cl.[7] ..... B41J 2/045; B41J 29/393
(52) U.S. Cl. ..... 347/68; 347/19
(58) Field of Search ..... 347/68, 19, 14, 347/12, 11, 10, 9, 59, 49, 23

(56) References Cited

U.S. PATENT DOCUMENTS 5,541,630 A 7/1996 Ema et al. ..... 347/68
5,777,637 A 7/1998 Takada et al. ..... 347/12
5,838,339 A 11/1998 Silverbrook ..... 347/68
5,841,452 A 11/1998 Silverbrook ..... 347/68
5,877,784 A * 3/1999 Maru et al. ..... 347/12
5,896,154 A 4/1999 Mitani et al. ..... 347/102
5,917,509 A 6/1999 Becerra et al. ..... 347/11
5,940,095 A * 8/1999 Parish et al. ..... 347/19

* cited by examiner

*Primary Examiner*—John Barlow
*Assistant Examiner*—Charles W. Stewart, Jr.
(74) *Attorney, Agent, or Firm*—Oliff & Berridge PLC

(57) ABSTRACT

The efficiency and speed in ink jet printing can be improved by adding a storage register between the shift register and the jet drive logic. By adding the storage register, jet print data that is serially loaded into the shift register can be parallel transferred to the storage register, where it is used by the jet drive logic to fire ink jets. While the jets are being fired new data is loaded and transferred to the storage registers to be used by the jet drive logic. This improves the system efficiency by eliminating the need for two extra pulses that are usually needed to load the first block of data and fire the last block of data.

12 Claims, 4 Drawing Sheets

PRELOAD OF DATA PRIOR TO FIRE PULSE BY USING A DUAL BUFFER SYSTEM IN INK JET PRINTING

BACKGROUND OF THE INVENTION

1. Field of Invention

This invention is directed to ink jet printers.

2. Description of Related Art

In operating ink jet printers and other devices that use ink jet technology, print heads that contain ink fire ink onto paper or other printable media through jets located in the print heads. Firing the individual jets of the ink jet print head is determined by the firing pulse of the system that operates the ink jet print head.

Data is transferred to the print heads by a control circuit. The control circuit controls the logic that determines how many jets to fire at a time and when to fire the jets. The data is held in the print heads until a fire pulse activates the print heads and the jets are fired. Typically four or eight jets are fired at a time. Each set of jets are fired sequentially until all the jets in the print head have been fired for the current position of the print head.

In operating an ink jet printer, smart logic ink jet print heads typically use a serial shift system to clock data into the print head. This information is decoded and used to determine which jets to fire. The first set of data is shifted into a register and then fired by an enable pulse. At the same time this first set is being fired, a second set of data is loaded into the register for the next set of jets to be fired. Once the first set of jets are fired, the second set can be fired using the second set of data loaded into the register, while a third set of data is loaded. This is continued until all the jets in the head have been fired for the current position of the print head.

SUMMARY OF THE INVENTION

However, in most ink jet printing devices, two extra pulses are needed to operate the jets. The first pulse is used to load the first set of data into the register. The second pulse is used to fire the last set of data.

This invention provides ink jet printing systems and methods that improve the efficiency and increase the speed of ink jet printing.

This invention separately provides double banking and/or ping-ponging ink jet printing systems and methods that eliminate the two extra pulses needed to operate the jets.

In various exemplary embodiments of the systems and methods according to this invention, double banking is used by adding a buffer between the shift register and the firing logic. The buffer or storage register eliminates the need for the two extra pulses.

In other exemplary embodiments of the systems and methods according to this invention, alternating, or "ping-ponging", between two buffers or registers is used to eliminate the need for the two extra pulses. Two different buffers or registers are used to store the data from the shift register. The two registers are alternatively selected. When one buffer or register is being fired using a current set of data, the other is loaded with the next set of data.

These and other features and advantages of this invention are described in or are apparent from the following detailed description of the apparatus/systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
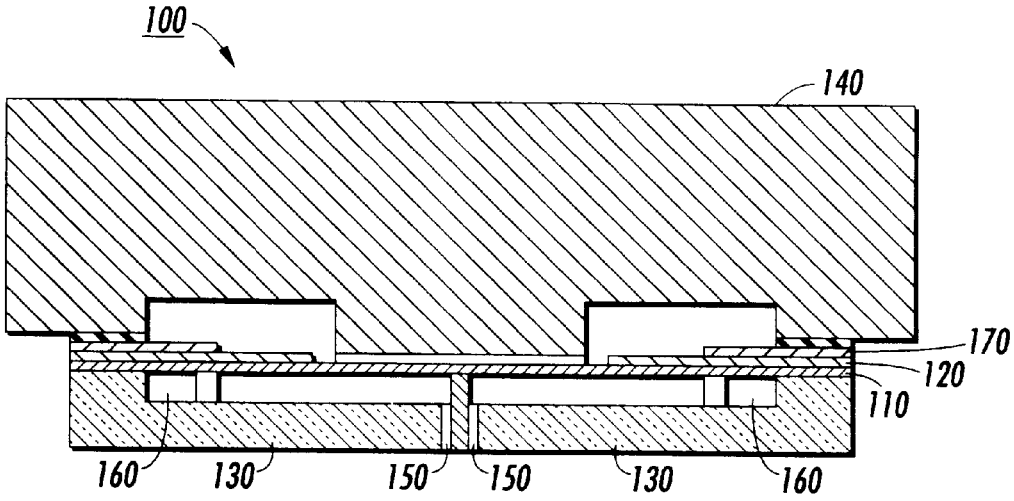
FIG. 1 is a cross sectional view of an ink jet print head.

FIG. 1 shows a cross sectional view of an ink jet print head 100. The ink jet print head includes a piezoelectric element 120 and a diaphragm 110 mounted on a substrate 130. The diaphragm 110 is located above the ink chamber 160 and nozzle 150. A electrode 170 is formed on top of the piezoelectric element 120. A support 140 is composed of a rigid material such as metal, a high rigidity resin or the like.

When voltage is applied to the electrodes 170, the piezoelectric element 120 changes shape and pushes on the diaphragm 110. The diaphragm 110 then exerts pressure on the ink, forcing an ink droplet out nozzle 150.

Figure 2:
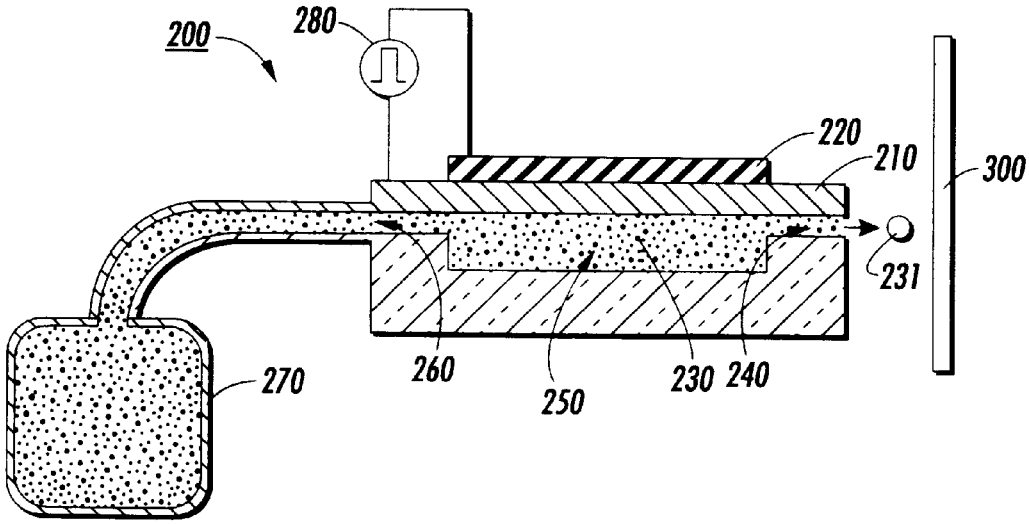
FIG. 2 is a schematic showing the basic principle of an ink jet print head.

FIG. 2 shows more clearly the general principle of how a print head functions. The print head 200 includes a piezoelectric element 220 attached on a diaphragm 210, and an ink fountain 270 supplies ink 230 to a pressure chamber 250 via an ink chamber 260. When a signal source 280 applies a voltage to the piezoelectric element 220, the corresponding part of the diaphragm 210 is stressed by the piezoelectric element pushing down on it. The diaphragm 210 correspondingly exerts pressure on the pressure chamber 250. Thus, the ink 230 is expelled, as an ink drop 231, from the corresponding nozzle 240 onto the paper 300. After the ink has been expelled, the diaphragm 210 returns to its original state. A negative pressure is generated in the pressure chamber 250 and the same amount of ink 230 that was expelled through nozzle 240 is replaced by this negative pressure. The negative pressure draws the ink 230 from the ink well 270 through the ink chamber 260 and into the ink pressure chamber 250. The print head is then again ready to be fired.

While the above-outlined description of FIGS. 1 and 2 is directed to piezoelectric ink jet printers, any other known or later developed type of ink jet printer, including thermal ink jet printers and acoustic ink jet printers, that use the data signals and firing pulses described below can incorporate either of the fire control systems according to this invention. Because the structure and general operation of such other ink jet printers are well known to those of ordinary skill in the art, or are easily understandable from the description of the conventional piezoelectric ink jet printer shown in FIGS. 1 and 2, a detailed description of these other types of ink jet printers is omitted.

Figure 3:
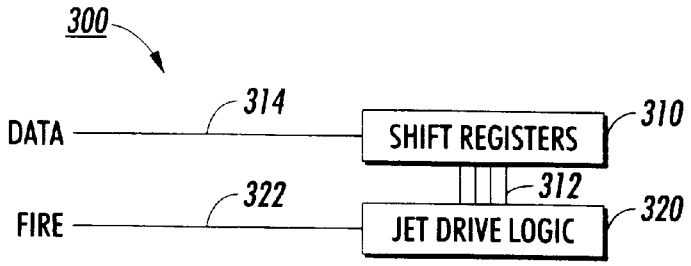
FIG. 3 PRIOR ART
FIG. 3 is a conventional control system for print heads.
Figure 4:
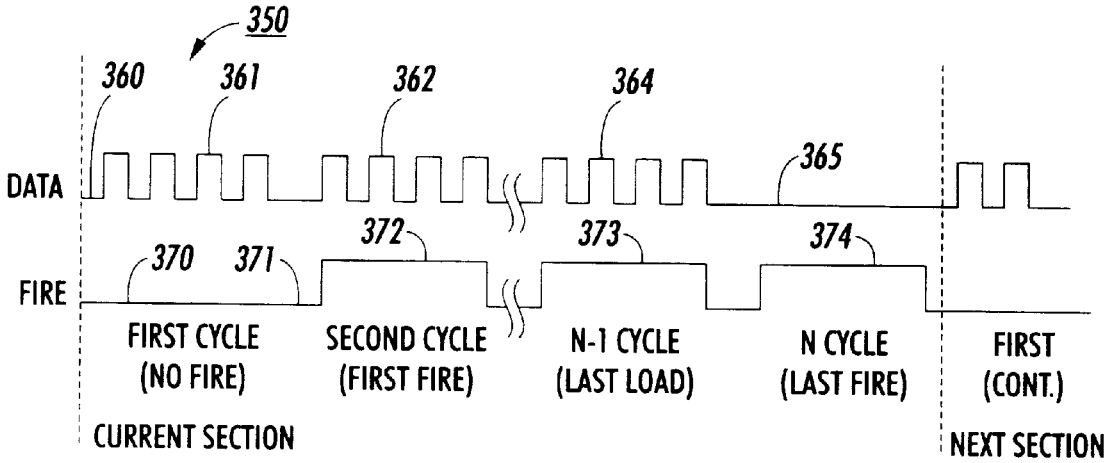
FIG. 4 PRIOR ART
FIG. 4 is the timing diagram for the conventional control system shown in FIG. 3.

FIGS. 3 and 4 show a conventional ink jet fire control system 300 and the timing diagram 350 for this conventional ink jet fire control system 300, respectively. The data is serially loaded into a shift register 310 through a data connection 314. The data is then loaded in parallel from the shift register 310 over the connections 312 to the jet drive logic 320. A data signal 360 on the signal line 314 is used to load data into the shift register 310. A first signal 370 on the fire line 322 is used to fire the print head jets in accordance with the data contained in the shift register 310.

As shown in FIG. 4, during a first cycle 361 of the data signal 360, a first set of the print data contained in a first cycle 361 of the data signal line 361 is loaded into the shift register 310. At this time, in a first cycle 371 of the fire signal 370, the fire signal 370 is not enabled. During a second cycle 362 of the data signal 360, the second set of data 362 is loaded into shift register 310.

At the same time, in a second cycle 372 of the fire signal 370, the fire signal is enabled. As a result, the jet drive logic 320 fires the print head jets in accordance with the first set of data contained in the first cycle 361 of the data signal 360 and stored in the shift register 310. During the next to last cycle 364 of the data signal 360, the last set of data 364 is loaded into shift register 310. The fire signal 373 of the fire signal 370 is enabled, while data 364 is loaded into shift register 310 and the print head jets are fired by the jet drive logic 320 using the previously stored set of data. This continues in the print section, until a last cycle.

During the last cycle of the data signal 360, no additional data is received at the shift register 310, therefore the last cycle 365 of the data signal 360 does not contain any data. At this time, however, during a last cycle 374 of the fire signal 370, the fire signal 370 is enabled to fire the jets using the last set of data received during the next to last cycle 364 of the data signal. Because shift register 310 already contains data from the previous cycle, the jet drive logic must use the data 364 to fire the jets to clear shift register 310 so that new data of the next print section can be received by shift register 310. That is, during this last cycle 374 of the fire signal 370, the print head jets are fired in accordance with the set of data 364 loaded into shift register 310 during the next to last cycle 364 using the fire pulse 374. After the last cycle of the data and fire signal 360 and 370 is complete, the next print section continues in the same manner as described above, with the first cycles of the data signal 360 and the fire signal 370.

Figure 5:
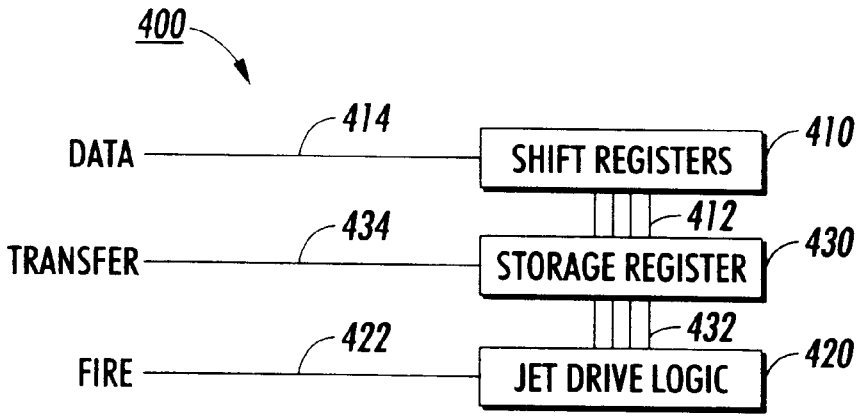
FIG. 5 is one exemplary embodiment of a control system for print heads using the double banking technique according to this invention.

FIGS. 5 shows one exemplary embodiment of an ink jet fire control system 400 according to this invention for transferring print data to be used in the firing of ink jets by the jet drive logic 420. In particular, FIG. 5 shows a double banking ink jet fire control system 400. The double banking system 400 serially loads print data, of a print section, into shift register 410 received over a connection 414. Once the data is loaded into the shift register 410, the data is then transferred in parallel from the shift register 410 to a storage register 430 over the connections 412. The data is then transferred to the jet fire logic 420 over the connections 432. The data is used by the jet fire logic 420 to fire the print head jets. At the same time that the print head jets are fired by the jet drive logic 420, using the print data stored in the storage register 430, a new set of print data is loaded into the shift register 410. This process is continued until all print sections are completed.

Figure 6:
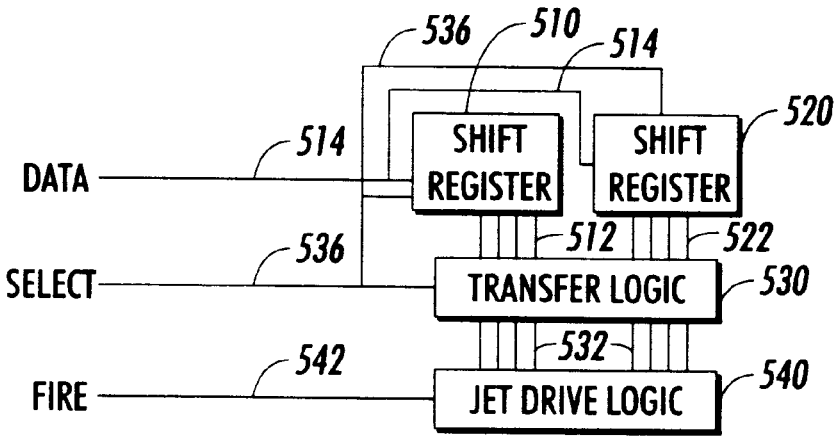
FIG. 6 is one exemplary embodiment of a control system for print heads using the ping-ponging technique according to this invention.

FIG. 6 shows an exemplary embodiment of a ping-ponging ink jet fire control system 500 according to this invention. The ping-ponging ink jet fire control 500 shown in FIG. 6 uses two shift registers 510 and 520 to store the print data. The transfer logic 530 alternately selects the data from one of the two shift registers 510 and 520 and transfers the data through the transfer logic 530 to the jet drive logic 540. The data is serially loaded into the shift registers 510 and 520 over the connections 514. The shift registers 510 and 520 are alternately loaded with the print data. In other words, if the shift register 510 is loaded with the first set of data, then the shift register 520 is loaded with the second set of data. Therefore, the shift registers 510 and 520 alternate loading each set of data.

After the print data is loaded into either the shift register 510 or the shift register 520, the print data in that shift register 510 or 520 is then transferred through the transfer logic 530, over the connections 512 or 522 and over the connections 532, to the jet drive logic 540. A select signal on a signal line 536 controls the alternate loading of the data into the shift registers 510 and 520. The select signal is also provided to the transfer logic 530, through the signal line 536. The transfer logic 530 is controlled by the select signal to select the print data contained in either the shift register 510 or the shift register 520 to send to the jet drive logic 540. The transfer logic 530 can be any known or later developed logic circuit, such as a multiplexer, that can alternately connect the two shift registers 510 and 520 to the jet drive logic 540 under control of a select signal.

As the print data is transferred from one of the shift registers 510 or 520 through the transfer logic 530 to the jet drive logic 540, new print data is loaded into the other shift register 510 or 520. For example, a first set of data is loaded into shift register 510. The first set of data is then transferred through the transfer logic 530 to the jet drive 540. The first set of print data is used by the jet drive logic 540 to fire the print head jets. At the same time that this first set of data is used by the jet drive logic 540, a second set of data is loaded into the shift register 520. The second set of print data is then provided to jet drive logic 540 through the transfer logic 530, where it is used by the jet drive logic 540, while a third set of print data is loaded into the first shift register 510. This process is repeated until all print sections have been printed.

Because the shift registers 510 and 520 transfer their print data directly to the jet drive logic 540, the last data that is used to fire the print head jets is accomplished with one of the shift registers 510 and 520 already cleared and ready to store the print data on the first cycle of the next print section. Therefore, as with the ink jet fire control system 400 shown in FIG. 5, the ink jet fire control system 500 does not require an extra pulse at the beginning and end of each print section. This increases the speed and efficiency of the entire system.

Figure 7:
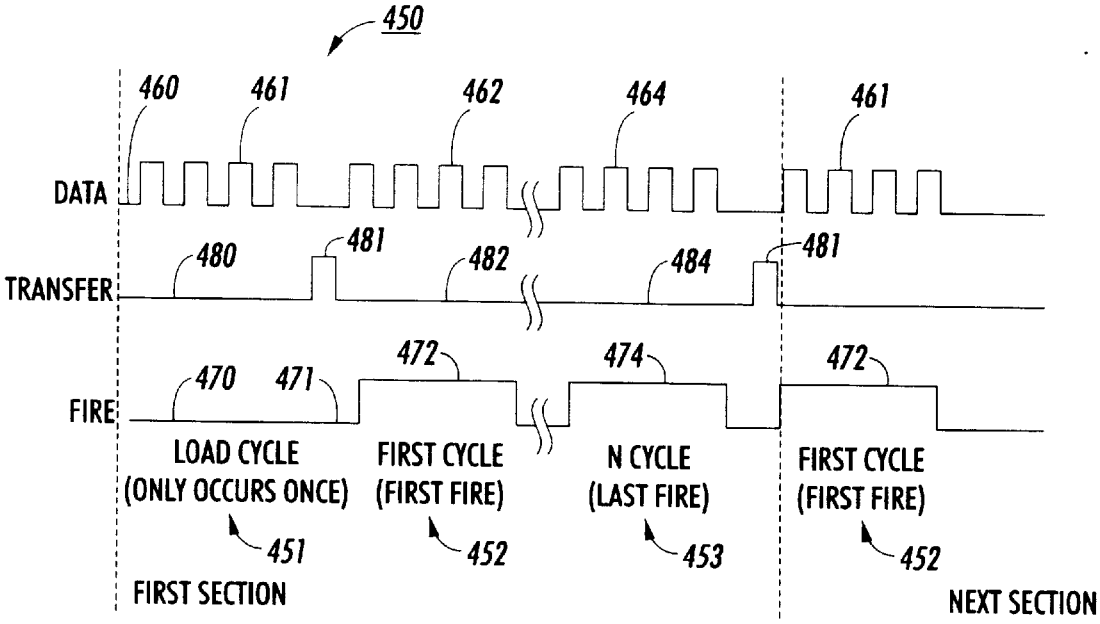
FIG. 7 is the timing diagram for the control system shown in FIG. 5.

FIG. 7 is a timing diagram 450 for the ink jet fire control system 400 shown in FIG. 5. During a load cycle 451, the data contained in a first data cycle 461 of the data signal 460 is loaded into the shift register 410. At this time, the transfer signal 480 is not enabled. Once all the data of the first data cycle 461 is loaded into the shift register 410, on an enable pulse contained on a first cycle 481 of the transfer signal 480 is then provided to the storage register 430. As a result, the data of the first data cycle 461 is transferred from the shift register 420 to the storage register 430. At this time, the first cycle 471 of the fire signal 470 does not enable the jet fire logic 420.

During the first cycle 452 of the first section of the timing diagram 450, the fire pulse in the first cycle 472 of the fire signal 470 is enabled. This causes the jet drive logic 420 to fire the first set of ink jets based on the print data in the first cycle 461 of the data signal 460 that is stored in the storage register 430. At the same time as the fire pulse 472 is enabled, data contained in the second data cycle 462 of the data signal 460 is loaded into the shift register 410. The transfer pulse in a second cycle 482 of the transfer signal 480 is then enabled to transfer the print data contained in the second cycle 462 to the storage register 430.

During the last cycle 453 of the first section of the timing diagram 450, the fire pulse for the last cycle 474 of the fire signal 470 is enabled and the print data of a next-to-last data cycle of the data signal 460 is used to fire the print head jets. The print data contained in the last cycle 464 of the data signal 460 received during the last cycle 453 of the first section of the timing diagram 450 is loaded into the shift register 410. The transfer pulse 481 in the last cycle 484 of the transfer signal 480 received during the last cycle 453 of the timing diagram 450 is enabled. In response, the print data contained in the last cycle 464 of the data signal 460 is transferred to the storage register 430. Once the print data contained in the last cycle 464 of the data signal 460 of the last cycle 453 of the first section of the timing diagram 450 is transferred to the storage register 430, the shift register 410 is cleared and the print data contained in the first cycle 461 of the data signal 460 on the first cycle 452 of the next section of the timing diagram 450 can be loaded into the shift register 410. Therefore, the transition from one print section to another is continuous. This process is continued in subsequent cycles and print sections. The last cycle in the print section therefore does not require an extra beginning or end pulse for the new print section.

The systems of FIG. 5 and 6 only require a full extra load cycle at the beginning or end of a print section. A print section can be a line, a portion of a page, a whole page or whatever is specified. Since a single line is greater than the number of jets in a print head, the efficiency is increased. To fire an entire print section, the total number of cycles:

Total number of cycles=(total number of jets)/(total number of jets to be fired at one time)

In the conventional systems that include the two extra pulses to fire an entire set of the ink jets for each position of the print head, the total number of cycles is:

Total number of cycles=2+((total number of jets)/(total number of jets to be fired at one time))

Therefore, if there are 128 jets in the print head and 8 jets are fired at one time, the total number of cycles per print head location for the conventional system is equal to 18. For just a single location of the print head, the total number of cycles such a print head, when using the systems and methods, of this invention, is equal to 16. This is an improvement of 12.5%. The exemplary embodiments of the invention decrease the number of cycles, while increasing the overall efficiency of the ink jet control system. The added chip area is also not significant, since the registers require low power and do not take up a lot of chip space. Thus, the overall performance is increased, while decreasing the size and power consumption of the chip.

While this invention has been described in conjunction with the exemplary embodiments outlined above, it is evident that many alternatives, modifications and variations will be apparent to those skilled in the art. Accordingly, the exemplary embodiments of the invention may be made without departing from the spirit and scope of the invention.

What is claimed is:

1. An ink jet printing system that fires jets contained in a print head, comprising:

at least one shift register;

a storage device; and a jet drive logic circuit;

wherein the at one shift register serially loads jet print data and transfers the jet print data in parallel to the storage device, the jet drive logic circuit fires the ink jets in accordance with the data in the storage device received on a cycle while the at least one shift register receives data for a new cycle.

2. An ink jet printing system according to claim 1, wherein loading of the ink jet print data into the at least one shift register is determined by a data clock signal.

3. An ink jet printing system according to claim 1, wherein transferring of the ink jet print data into the storage device is determined by a transfer clock signal.

4. An ink jet printing system according to claim 1, wherein firing of the ink jets is determined by a fire clock signal.

5. An ink jet printing system that fires ink jets contained in a print head, comprising:

at least two shift registers that alternatingly obtain print data from a data signal;

a transfer logic circuit that transfers print data from one of the at least two shift registers to a jet drive logic circuit, while an other one of the at least two shift registers obtains new print data;

wherein the jet drive logic circuit fires the ink jets in accordance with the print data received from one of the at least two shift registers.

6. An ink jet printing system according to claim 5, wherein the print data is loaded into the other one of the at least two shift registers from the data signal.

7. An ink jet printing system according to claim 5, wherein the print data is alternatingly loaded into the shift registers.

8. An ink jet printing system according to claim 7, wherein a select signal controls which of the at least two shift registers the print data is loaded into.

9. An ink jet printing system according to claim 8, wherein the transfer logic circuit is controlled by the select signal to select data contained in at least one of the at least two shift registers to provide data to the jet drive logic circuit.

10. An ink jet printing system according to claim 5, wherein the jet drive logic fires the ink jets in accordance with a fire signal.

11. An ink jet printing method for firing jets contained in a print head, including:

loading a current set of jet print data into a shift register;

transferring the jet print data to a storage device in response to a transfer signal;

driving the jets based on the jet print data stored in the storage device and while the jets are being driven loading a next set of the jet print data into the shift register.

12. An ink jet printing method for firing jets contained in a print head, including:

loading a current set of jet print data alternatingly into one of at least two shift registers;

transferring the jet print data using a transfer logic circuit, from one of the at least two shift registers to a jet drive logic circuit, while an other one of the at least two shift registers obtains new jet print data;

driving the jets based on the jet print data received from at least one of the two shift registers; and repeating the transferring, driving and loading steps.

* * * * *